United States Patent [19]

Swistak

[11] Patent Number: 4,603,964

[45] Date of Patent: Aug. 5, 1986

[54] PHOTORECEPTOR CHARGING SCOROTRON

[75] Inventor: Gregory B. Swistak, Rochester, N.Y.

[73] Assignee: Xerox Corporation, Stamford, Conn.

[21] Appl. No.: 663,633

[22] Filed: Oct. 22, 1984

[51] Int. Cl.[4] ..... G03G 15/02

[52] U.S. Cl. ..... 355/14 CH; 355/3 CH; 361/235; 250/325

[58] Field of Search ..... 355/3 CH, 14 CH; 361/225, 229, 230, 235; 250/324–326; 430/902

[56] References Cited

U.S. PATENT DOCUMENTS

| | | | |
|---|---|---|---|
| 3,527,941 | 9/1970 | Culhane et al. | 250/49.5 |
| 3,578,970 | 5/1971 | Michaud et al. | 250/325 |
| 3,944,356 | 3/1976 | Hayne | 355/3 R |
| 4,123,156 | 10/1978 | Inowa et al. | 355/3 SC |
| 4,233,511 | 11/1980 | Harada et al. | 250/325 |
| 4,550,253 | 10/1985 | Hashimoto | 355/3 CH X |

FOREIGN PATENT DOCUMENTS

| | | | |
|---|---|---|---|
| 55-120048 | 9/1980 | Japan | 355/3 CH |
| 56-91251 | 7/1981 | Japan . | |
| 56-147787 | 3/1983 | Japan | 355/14 CH |

OTHER PUBLICATIONS

*Xerography and Related Processes,* edited by Dessauer, John H., et al., Focal Press, London, 1965, p. 202.

*Primary Examiner*—Arthur T. Grimley
*Assistant Examiner*—J. Pendegrass
*Attorney, Agent, or Firm*—Frederick E. McMullen

[57] ABSTRACT

A charge scorotron having a U-shaped shield positionable opposite a photoreceptor, a corona discharge wire in the shield, a grid between the wire and the photoreceptor for controlling the emission of ions to the photoreceptor, the grid being electrically subdivided into a first grid segment with a length substantially equal to the dimension of the smallest size copy sheet with subsequent grid segments having lengths chosen when combined with the first grid segment and each other to substantially equal various larger size copy sheets, switches responsive to the position of an adjustable sheet guide in the copy sheet supply tray connecting each of the other grid segments with the grid bias selectively, the switches when not actuated coupling the grid segment associated therewith to ground whereby the area of the photoreceptor charged is determined by the number of grid segments coupled to the grid bias in response to the size copy sheet being processed.

3 Claims, 3 Drawing Figures

PHOTORECEPTOR CHARGING SCOROTRON

The invention relates to apparatus and method for charging the photoreceptor of an xerographic system in preparation for imaging, and more particularly, to an improved apparatus and method for controlling the area of the photoreceptor charged in accordance with the size copy image being produced.

In xerographic type copiers and printing machines, one of the essential and indeed critical steps in that process involves placing a uniform charge of the current polarity and potential on the machine photoreceptor. Thereafter, as will be understood by those skilled in the art, the charged photoreceptor is exposed by high intensity radiation, typically light, to selectively discharge the photoreceptor and create a latent electrostatic image of the image original being copied on the photoreceptor. The source of the image original as will be understood may be an image bearing document or may be in the form of electrical signals.

Thereafter, the electrostatic latent image created on the photoreceptor is developed by toner and the toner image transferred to a suitable copy substrate, typically a sheet of paper. The copy sheet bearing the toner image is thereafter fused or fixed to render the copy permanent while the photoreceptor is cleaned preparatory to charging again.

In the aforementioned charging process, the entire area of the photoreceptor is charged. In many applications and uses however, the latent image formed on the photoreceptor is smaller in size than the operative area of the photoreceptor leaving one or more charged but unused, that is, non-image areas. Typically, this situation occurs when the machine is operated in a reduction mode or in an open platen mode when the image original does not cover the available image area. As a result, the size of the photoreceptor area exposed is smaller than the photoreceptor operating area. If left unattended, each fully charged non-image area will, because of the high charge state, be developed out heavily with consequent rapid reduction of the machine toner supply. At the same time, a heavy cleaning load is imposed on the photoreceptor cleaning components which must clear the heavy deposit of toner from the photoreceptor preparatory to charging.

The prior art has addressed this problem by providing one or more small exposure lamps, often referred to as edge fadeout lamps. These lamps, which are actuated when the width of the image exposure area is smaller than the operating width of the photo receptor, discharge any non-image area laying alongside the image prior to developing through exposure to light. And to accommodate a variety of image sizes, multiple edge fade out lamps of different widths are often used or, in the alternative, a movable shutter or curtain is provided to effectively vary the width of the light area discharged.

The invention relates to a scorotron for charging the photoreceptor in a xerographic type copying or printing machine, comprising in combination: a generally U-shaped shield adapted to be supported with the shield open end in predetermined spaced facing relation with the photoreceptor and with the axis of the shield being substantially perpendicular to the direction of movement of the photoreceptor; at least one wire-like corona emitting element operatively disposed with the shield, the length of the corona emitting element being substantially equal to the width of the photoreceptor; an apertured grid interposed between the corona emitting element and the shield open end to control the flow of ions through the shield open end; grid biasing means for imposing a predetermined high or low bias on the grid; and means for separating the grid into at least two electrically isolated grid segments of predetermined axial length capable of being individually coupled with the grid biasing means so that the area of the photoreceptor charged by the scorotron may be varied by varying the number of the grid segments connected to the grid biasing potential whereby photoreceptor sections not requied for imaging remain uncharged due to failure to connect the grid segment or segments associated therewith to the grid biasing means.

The invention further relates to a xerographic type copying or printing apparatus comprising in combination: a movable photoreceptor; means to charge the photoreceptor in preparation for imaging; exposure means for exposing the photoreceptor following charging to create a latent electrostatic copy image on the photoreceptor; developing means for developing the copy image; transfer means for transferring the developed image to a copy substrate material; the charging means including at least one corona emitting wire adapted when actuated to emit ions for charging the photoreceptor, the axis of the corona wire being substantially perpendicular to the direction of movement of the photoreceptor with the axial length of the corona wire being substantially equal to the operating width of the photoreceptor, and grid means interposed between the corona wire and the photoreceptor for controlling charging of the photoreceptor by the corona wire; means for electrically separating the grid means into a succession of grid segments, each of the grid segments having a predetermined axial length for controlling charging of a corresponding area of the photoreceptor by the corona wire; means for biasing the grid segments to control the flow of ions from the corona wire to the photoreceptor; and control means for coupling selected ones of the grid segments to the potential source in response to the size copy image being produced whereby to correlate the area of the photoreceptor charged by the charging means with the size of the copy image produced or the size of the document being copied.

The invention further relates to the method of varying the area of the photoreceptor in a xerographic system that is charged in preparation for imaging in accordance with the size of the copy image being produced to avoid the creation of charged non-image areas at the sides of the copy image, the xerographic system having a scorotron opposite the photoreceptor with at least one corona emitting wire for generating ions for charging the photoreceptor and a grid interposed between the wire and the photoreceptor to control the flow of ions to the photoreceptor, comprising the steps of: segregating the grid into at least two individual grid segments of predetermined length corresponding to different copy image sizes; and selectively biasing the grid segments individually in accordance with the size of the copy image to be produced to limit the area of the photoreceptor charged by the scorotron to the photoreceptor area substantially opposite those grid segments which are biased.

IN THE DRAWINGS

Figure 1:
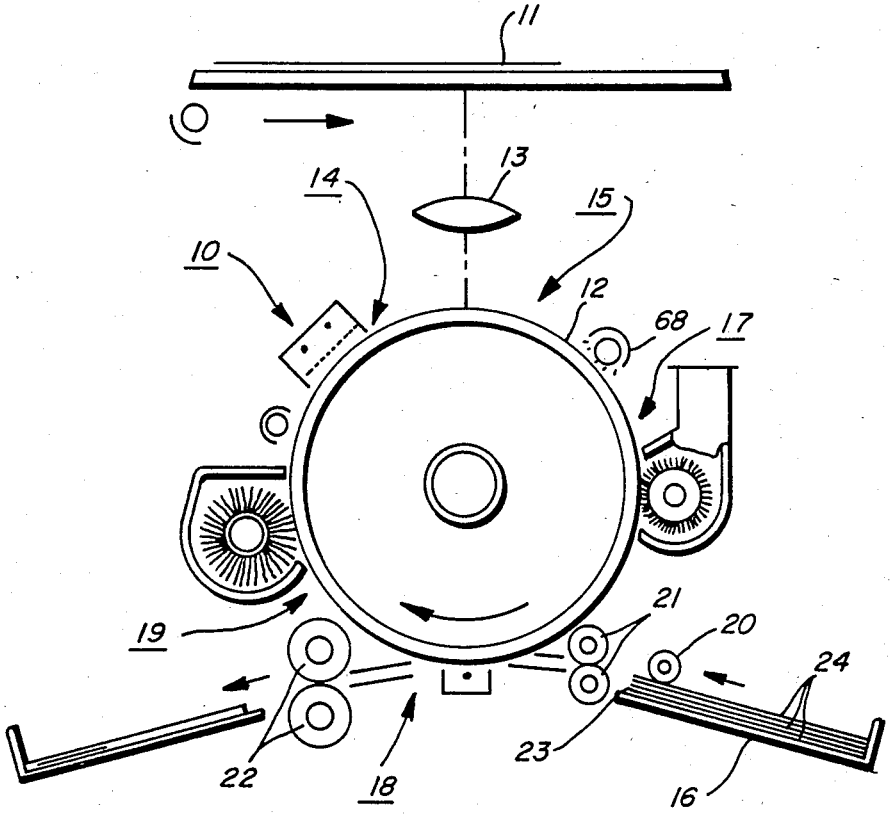
FIG. 1 is a schematic view of an exemplary xerographic type copying or printing machine incorporating the variable charge scorotron of the present invention.

Referring to the drawing Figures, there is shown the variable charge scorotron, designated generally by the numeral 10, of the present invention. Scorotron 10 serves to charge the photoreceptor 12 of a xerographic system in preparation for imaging. Photoreceptor 12, which may comprise any suitable photoconductive material such as Selenium and may be in any suitable form such as drum, belt, web, etc., is moved in the direction shown by the solid line arrow by suitable drive means (not shown).

As will be understood by those skilled in the xerographic arts, xerographic systems of the type alluded to provide a series of xerographic processing stations about photoreceptor 12, the principal ones of which comprise a charge station 14 where the photoreceptor is uniformly charged by scorotron 10 in preparation for imaging, an exposure station 15 where the previously charged photoreceptor is exposed to create a latent electrostatic copy image of the document 11 being copied thereon, a developing station 17 where the latent electrostatic copy image is developed by a suitable toner, a transfer station 18 where the developed image is tranferred to a suitable copy substrate such as copy sheet 24, and a cleaning station 19 where the surface of photoreceptor 12 is cleaned to remove any leftover toner or other particles preparatory to charging by scorotron 10. Suitable optical means 13 are provided for focusing the document 11 onto photoreceptor 12 at exposure station 15, it being understood that optical means 13 may incorporate means to reduce the copy image size.

While a light/lens exposure system is illustrated, exposure by means of a scanning beam modulated in accordance with an image signal input may be envisioned instead.

Copy sheets 24 may be supplied from one or more paper supply trays exemplified herein by tray 16. Suitable copy sheet feeding and transport means such as sheet feed roll 20 and sheet transport roll pairs 21, 22 are provided for feeding one copy sheet 24 at a time for the stack 23 of copy sheets in tray 16 and bringing the sheet 24 forward into transfer relation with photoreceptor 12 at transfer station 18 in timed registration with the developed image on photoreceptor 12.

Figure 2:
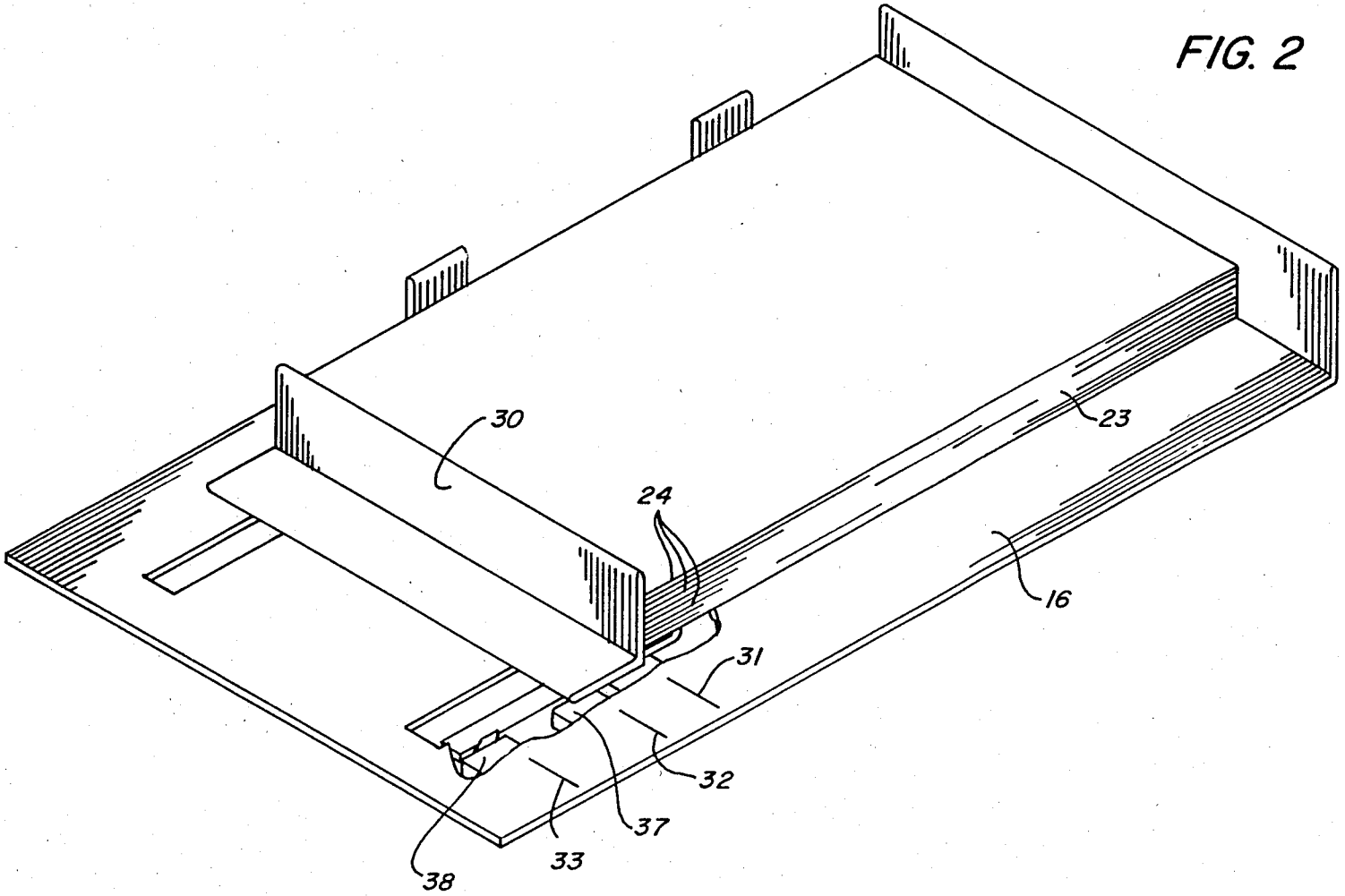
FIG. 2 is an enlarged isometric view showing details of the adjustable paper supply tray for the machine shown in FIG. 1.

Referring particularly to FIG. 2 of the drawings, typically a copy sheet supply tray such as tray 16 has means such as movable side guide 30 for adjusting the effective width of the tray in accommodation of the size copy sheets being handled. In the exemplary construction shown, side guide 30 has three copy sheet size positions, a minimum copy sheet size position 31, an intermediate copy sheet size position 32, and a maximum copy sheet size position 33. Suitable detectors, which may for example comprise switches 37, 38 actuable through engagement with the movable side guide 30, are provided to sense when side guide 30 is adjusted for the larger copy sheet sizes, that is, the intermediate and maximum copy sheet size positions corresponding to positions 32, 33 respectively.

Various other ways of providing different size copy sheets may instead be envisioned such as for example different sized paper trays that are manually exchanged when switching from one copy sheet size to another, multiple paper trays each holding different size copy sheets with a control on the operator control panel permitting the operator to select the paper tray and copy sheet size desired, etc. Whatever the means utilized to provide different size copy sheets, there would also be provided suitable means for detecting the size copy sheet selected such as the aforementioned switches 37, 38, means responsive to the operator's control panel selection, electronic copy sheet size detecting means, etc.

Figure 3:
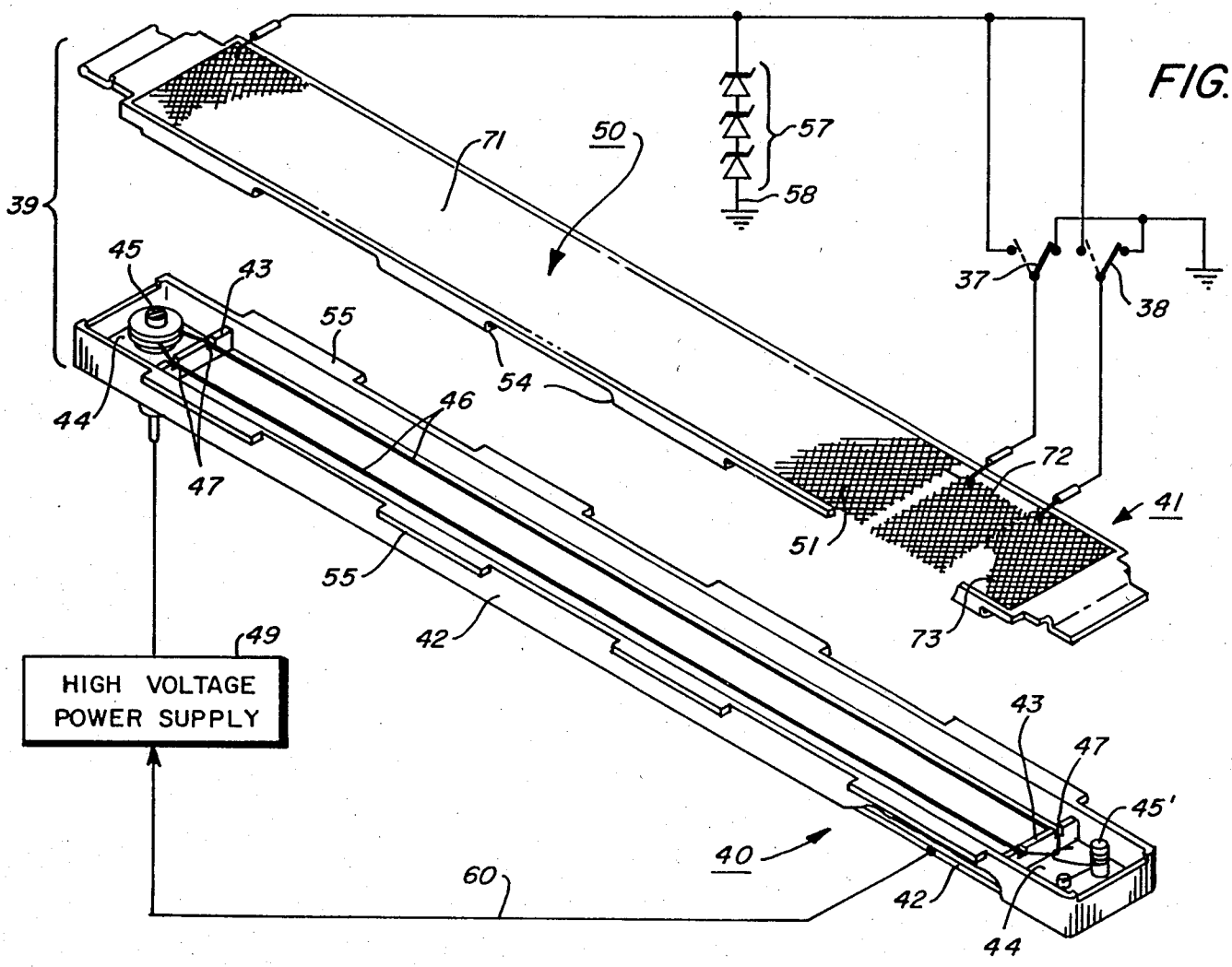
FIG. 3 is an enlarged isometric view with parts broken away showing details of the variable charge scorotron shown in FIG. 1 and the operating control therefore.

Referring particularly to FIG. 3 of the drawings, scorotron 10 has an elongated generally U-shaped shield 39 composed of frame members 40, 41 which are assembled together. Frame members 40, 41 may be formed from any suitable rigid, non-conducting material such as plastic. A metal back plate 42 is assembled with frame member 40 to form the outer wall of scorotron 10. Each end of the frame member 40 is separated by a divider 43 into a small compartment 44 within which mounting posts 45, 45' for corona wire 46 are provided, wire 46 being stretched tightly over posts 45, 45' and running from post 45 to post 45' and from post 45' back to post 45. Small slotlike openings 47 are provided in divider 43 to accommodate and locate corona wire 46 within the frame member 40, with the overall length of corona wire 46 between dividers 43 being at least equal to the operating width of photoreceptor 12. Mounting post 45 is electrically conductive to provide a conduit for coupling corona wire 46 with a suitable high voltage power supply (H.V.P.S.) 49, which may comprise either a dc, or ac, or combined ac/dc type electrical source as will be understood. A feedback loop 60 between back plate 42 and the control gate of power supply 49 controls the potential applied to corona wire 46 in accordance with the corona discharge level to maintain a desired charge level on photoreceptor 12. While a two corona wire design is shown, a single corona wire or other corona wire multiplies may be contemplated.

Frame member 41 has a hollow rectangular shape with an apertured grid 50, which in the example shown comprises an expanded open mesh metal screen 51, stretched thereacross, frame member 41 being sized to fit over the open end of frame member 40 with grid 50 in predetermind spaced relation with corona wire 46. Frame member 41 has a plurality of depending U-shaped tracks 54 spaced along the sides thereof to fit over and interlock with protruding lugs 55 provided along the sides of frame member 40, tracks 54 sliding over lugs 55 to interlock frame member 41 in preset operating position with frame member 40 on assembly of frame members 40, 41 with one another. An operating potential for biasing grid 50 is derived through a series of zener diodes 57 connected through line 58 to ground.

Scorotron 10 is suitably mounted in the copy machine with grid 50 facing toward and in predetermined spaced relation to photoreceptor 12.

As will be understood, during the copying process, non-image areas result before the first and after the last copy image. Where a series of copy images are generated on photoreceptor 12 as when making multiple copies, a non-image area typically results in the space or interdocument area between each image. These are fully charged areas of the photoreceptor 12 and if not erased or discharged, will be developed out as solid black areas at developing station 17. This results in a heavy drain in the supply of toner as well as imposing a heavy load on the cleaning apparatus at cleaning station 19 where the photoreceptor is cleaned prior to charging. In order to obviate this, a discharge device such as lamp 68 is provided upstream of developing station 17, lamp 68 being designed, when actuated, to illuminate the width of photoreceptor 12 and discharge any of the aforedescribed top, bottom, and interdocument non-image areas of photoreceptor 12. Suitable control means (not shown) are provided to turn lamp 68 on and off in timed synchronization with the position of the latent electrostatic images on photoreceptor 12 to assure discharge of the aforesaid non-image areas without discharging the copy image.

Similarly, where the width of the copy image is less than the effective width of photoreceptor 12 (as for example occurs when the document 11 is being reduced), a charged but unused non-image area will result on one or both sides of the copy image. Since the non-image area or areas created is at the side of the copy image and co-terminus therewith, discharge lamp 68 cannot be used to discharge these non-image areas without undesirable erasure of the copy image.

Typically, to reduce the incidence of the non-image areas that may result along the sides of the copy image, registration means (not shown) are normally provided to pre-locate the document 11 so that one side of the copy image is co-terminus with one edge of photoreceptor 12. However, there may still remain a non-image area between the other side of the copy image and the opposite edge of photoreceptor 12, which if not removed or neutralized will be undesirably developed with toner at developing station 17. To obviate this, the variable charge scorotron 10 of the present invention controls the size of photoreceptor 12 that is charged in accordance with the size of the copy being produced as will appear.

Referring particularly to FIG. 3, grid 50 is electrically separated into grid segments 71, 72, 73 of predetermined length which are selectively combined to charge an area of photoreceptor 12 corresponding to the copy sheet size for which side guide 30 of paper tray 16 is set as will appear. In the arrangement shown, grid segment 71 corresponds to setting of tray side guide 30 to the minimum copy sheet size position 31, grid segments 71, 72 together to the setting of guide 30 to the intermediate copy sheet size position 32, and grid segments 71, 72, 73 together to the setting of guide 30 to the maximum copy sheet size position 33. As described, a grid biasing potential is derived from zener diodes 57 and grid segment 71, which is used in all cases, is coupled directly to zener diodes 57. Grid segments 72 and 73 are coupled to zener diodes 57 through paper tray swithces 37, 38 respectively, actuation of switches 37, 38 by side guide 30 of tray 16 to the dotted line position shown in FIG. 3 coupling the grid segments 72, 73 associated therewith to zener diodes 57 to establish a bias on grid segments 72, 73. When in the solid line position shown, switches 37, 38 couple the grid segments 72, 73 associated therewith to ground.

During operation of the xerographic system, high voltage power supply 49 is actuated to operate scorotron 10 and charge photoreceptor 12. Concurrently, a grid biasing potential is derived through zener diodes 53 and applied to grid segment 71 to charge an area of photoreceptor 12 substantially equal to length of grid segment 71. Depending on the operating condition of switches 37, 38, grid segments 72, 73 may also have a grid biasing potential applied thereto to charge an area of photoreceptor 12 substantially equal to the combined length of grid segments 71 and 72 or an area of photoreceptor 12 substantially equal to the combined length of grid segments 71, 72 and 73.

In the exemplary arrangement shown, side guide 30 of tray 16 is set to the minimum copy sheet size position 31 and accordingly only grid segment 71 has a bias applied thereto. Switches 38, 39 are in the solid line position shown in FIG. 3 and accordingly the grid segments 72, 73 are connected directly to ground. As a result, only an area of photoreceptor 12 substantially corresponding to the minimum size copy sheet for which side guide 30 of tray 16 is set is charged by scorotron 10. Ions emitted from the remainder of corona wire 44 and striking grid segments 72, 73 flow to ground.

In the event side guide 30 of tray 16 is moved to the intermediate copy sheet size position 32, guide 30 sets switch 37 to the dotted line position shown in FIG. 3. As a result, both grid segments 71 and 72 are coupled to zener diodes 57 simultaneously and an area of photoreceptor 12 substantially corresponding to the combined length of grid segments 71, 72 is charged by scorotron 10.

Similiarly, movement of side guide 30 to the maximum copy sheet size position 33 sets both switches 37 and 38 to the dotted line position shown. As a result, grid segments 71, 72, 73 are coupled to zener diodes 57 simultaneously and the entire operating area of photoreceptor 12 is charged by scorotron.

While control over grid segments 72, 73 is disclosed as being in response to the size copy sheet for copy sheet supply tray 16 is set, other controls such as a control on the machine control panel enabling the operator or user to select the number of grid segments to be used, etc., may be contemplated in lieu of or in addition to copy sheet size. Furthermore, while grid 50 is shown and described as being segregated into grid segments 71, 72, 73, the number of grid segments may range from two to any desired number. And it will be understood that the location of the various grid segments along grid 50 may be different from that shown. For example, minimum sheet segment 71 may be centered with one or more smaller segments on each side thereof.

While a common source of grid biasing potential is shown for biasing the grid segments, a different bias may be used for segments 72, 73 either individually or in unison. And while grid segments 72, 73 are illustrated as being grounded when it is desired not to charge the area of photoreceptor 12 controlled by grid segments 72, 73, segments 72, 73 may instead by coupled to a predetermined second bias for this purpose. Further, it will be understood that prior residual charges on the uncharged areas of photoreceptor 12 may be drawn through the unused grid segments to ground and this may be enhanced by applying a suitable bias such as a negative bias to the unused grid segments in place of ground.

While the invention has been described with reference to the structure disclosed, it is not confined to the details set forth, but is intended to cover such modifications or changes as may come within the scope of the following claims.

I claim:

1. In a xerographic type copying or printing apparatus having a movable photoreceptor; exposure means for exposing the photoreceptor to create a latent electrostatic copy image on the photoreceptor; developing means for developing the copy image; and transfer means for transferring the developed image to a copy substrate material; the combination of:

(a) an elongated generally U-shaped shield having a conductive back plate with non-conductive side members, said shield being supported in spaced relation with said photoreceptor with the open side of said U-shaped shield facing said photoreceptor, the longitudinal axis of said shield being substantially perpendicular to the direction of photoreceptor movement;

(b) at least one corona emitting wire in said shield adapted when actuated to emit ions for charging the photoreceptor, the axis of said corona wire being substantially perpendicular to the direction of movement of said photoreceptor with the axial length of said corona wire being substantially equal to the operating width of said photoreceptor;

(c) means to apply a potential between said corona wire and said back plate whereby said corona wire emits said ions;

(d) grid means interposed between said corona wire and said photoreceptor for controlling the passage of ions from said corona wire to said photoreceptor;

(e) means for electrically separating said grid means into a succession of grid segments, each of said grid segments having a predetermined axial length for controlling charging of a corresponding area of said photoreceptor by said corona wire;

(f) a source of potential for biasing said grid segments to control the flow of ions from said corona wire to said photoreceptor;

(g) means coupling a predetermined first one of said grid segments to said potential source whereby on actuation of said machine an area of said photoreceptor corresponding to the length of said first grid segment is charged, and (h) control means for coupling selected ones of the remaining grid segments to said potential source in response to second image sizes being produced whereby to correlate the area of said photoreceptor charged by said charging means with the second image size being produced;

said control means including switch means associated with each of the remaining ones of said grid segments, said switch means serving when actuated to a first switch condition to couple the grid segment associated therewith to said potential source whereby actuation of one or more of said switch means to said first switch condition couples succeeding ones of said grid segments to said potential source whereby to increase the area of said photoreceptor charged by said charging means;

(i) said second image sizes being larger than said first image size.

2. The apparatus according to claim 1 in which said switch means when in a second switch condition couple the grid segment associated therewith to ground.

3. The method of varying the area of the photoreceptor in a xerographic system that is charged in preparation for imaging in accordance with the size of the copy image being produced to avoid the creation of charged non-image areas at the sides of the copy image, said xerographic system having a scorotron opposite said photoreceptor with at least one corona emitting wire for generating ions for charging the photoreceptor and a grid interposed between the wire and the photoreceptor to control the flow of ions to the photoreceptor, comprising the steps of:

(a) segregating said grid into a first relatively long grid segment to enable said scorotron to charge a photoreceptor area corresponding to a first copy image size and at least one second grid segment combinable with said first grid segment to enable said scorotron to charge a photoreceptor area corresponding to a second copy image size, said second copy image size being larger than said first copy image size;

(b) biasing said first grid segment whenever said first and second copy image sizes are produced by said xerographic system while grounding said second grid segment to substantially interrupt the flow of ions to the photoreceptor area substantially opposite thereto; and (c) biasing said second grid segment whenever said second copy image size is produced.

* * * * *